US008579657B2

(12) United States Patent
Reibke et al.

(10) Patent No.: US 8,579,657 B2
(45) Date of Patent: Nov. 12, 2013

(54) ELECTRIC TERMINAL FOR LEADING A LINE THROUGH A WALL

(75) Inventors: Heinz Reibke, Bad Salzuflen (DE); Rudolf Merz, Detmold (DE); Guohua Chen, Nanjing (CN); Dennis Sprenger, Hom-Bad Meinberg (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/265,038

(22) PCT Filed: Apr. 13, 2010

(86) PCT No.: PCT/EP2010/002264

§ 371 (c)(1),
(2), (4) Date: Dec. 29, 2011

(87) PCT Pub. No.: WO2010/121728

PCT Pub. Date: Oct. 28, 2010

(65) Prior Publication Data

US 2012/0100740 A1 Apr. 26, 2012

(30) Foreign Application Priority Data

Apr. 20, 2009 (DE) ..... 10 2009 017 836

(51) Int. Cl.
*H01R 13/60* (2006.01)

(52) U.S. Cl.
USPC ..... 439/533; 439/908

(58) Field of Classification Search
USPC ..... 439/533, 564, 565, 709, 722, 724, 908
See application file for complete search history.

(56) References Cited

U.S. PATENT DOCUMENTS 4,174,147 A * 11/1979 Waddington et al. ..... 439/636

(Continued)

FOREIGN PATENT DOCUMENTS

| | | |
|---|---|---|
| DE | 78 13 854 | 10/1979 |
| DE | 36 13 681 | 6/1987 |
| EP | 1 850 425 | 10/2007 |

OTHER PUBLICATIONS

International Search Report; PCT/EP2010/002264; International Filing Date: Apr. 13, 2010; Phoenix Contact GMBH & Co. KG; 6 pages.

International Search Report dated Sep. 28, 2010; PCT/EP2010/002262; International Filing Date: Apr. 13, 2010; Phoenix Contact GMBH & Co. KG; 3 pages.

Anonymous: "High VoltageHochstrom-Durchführungsklemmen" Internet Citation; Apr. 15, 2003, pp. 1-6; Retrieved from the Internet: URL:http://www.onlinecomponents.com/productfiles/mr-PH/phoenix_0717238_3.pdf.

(Continued)

*Primary Examiner* — Thanh Tam Le

(74) *Attorney, Agent, or Firm* — Schmeiser, Olsen & Watts, LLP

(57) ABSTRACT

The invention relates to an electric terminal for leading a conductor through a wall, comprising a first terminal piece (1) to be mounted on one side of the wall, and a second terminal piece (2) to be mounted on the other side of the wall. The first terminal piece (1) has a first connecting element (5) and a holding element (7) for positioning the first connecting element (5), while the second terminal piece (2) has a busbar (4) to be electrically connected to the first connecting element (5). According to the invention, the first connecting element (5) in such an electric terminal for leading a conductor through a wall can be connected to the conductor and/or the busbar (4) in a particularly simple fashion because the first connecting element (5) is positioned in the first terminal piece (1) by the holding element (7).

14 Claims, 2 Drawing Sheets

(56) References Cited

U.S. PATENT DOCUMENTS

| | | | | | |
|---|---|---|---|---|---|
| 4,231,631 | A | * | 11/1980 | Guerinault et al. | 439/559 |
| 4,405,196 | A | * | 9/1983 | Fulton | 439/551 |
| 4,630,882 | A | * | 12/1986 | Naylor et al. | 439/444 |
| 4,722,701 | A | * | 2/1988 | Bradt | 439/718 |
| 5,197,903 | A | | 3/1993 | Casey et al. | |
| 5,213,520 | A | * | 5/1993 | Casey et al. | 439/559 |
| 5,449,300 | A | | 9/1995 | Yoon | |
| 5,671,273 | A | * | 9/1997 | Lanquist | 379/413.04 |
| 7,074,093 | B2 | * | 7/2006 | Saka et al. | 439/724 |
| 7,094,098 | B2 | * | 8/2006 | Miyazaki | 439/559 |
| 7,559,810 | B1 | * | 7/2009 | Wu | 439/801 |
| 7,960,649 | B2 | | 6/2011 | Giefers | |

OTHER PUBLICATIONS

Written Opinion of the International Searching Authority; PCT/EP2010/002262; International Filing Date: Apr. 13, 2010; Phoenix Contact GMBH & Co. KG; 7 pages.

Written Opinion; PCT/EP2010/002264; International Filing Date: Apr. 13, 2010; Phoenix Contact GMBH & Co. KG; 14 pages.

International Preliminary Report on Patentability; PCT/EP2010/002264; International Filing Date: Apr. 13, 2010; Phoenix Contact GMBH & Co. KG; 15 pages.

International Preliminary Report on Patentability dated Oct. 25, 2011; PCT/EP2010/002262; International Filing Date: Apr. 13, 2010; Phoenix Contact GMBH & Co. KG; 8 pages.

* cited by examiner

ELECTRIC TERMINAL FOR LEADING A LINE THROUGH A WALL

FIELD OF TECHNOLOGY

The following relates to an electric terminal for leading a line through a wall, which electric terminal comprises a first terminal piece to be mounted on one side of the wall and a second terminal piece to be mounted on the other side of the wall.

BACKGROUND

Electric terminals are of great importance in different fields of application such as industrial connection technology and they serve, for example, for connecting electric components. Electric terminals of the type in question have been developed preferably for devices having closed housings and they are well-known in the form of so-called lead-through terminals for leading a line through a wall of the housing.

Lead-through terminals are disclosed in the prior art, in which the first terminal piece bears against an internal surface of the housing in the form of an internal terminal piece, and the second terminal piece bears against an external surface of the housing in the form of an external terminal. Furthermore, lead-through terminals are known in the prior art, in which an insulation component provided on the internal surface of the housing counteracts the external terminal piece. In many cases, the internal terminal piece and/or the external terminal piece comprise a screw-connection member, a connecting pin, a solder connection, a slip-on connection, a ring-cable connection or a wire-wrapped connection for establishing contact with the line.

In many cases, the disclosed first terminal pieces and the second terminal pieces of the lead-through terminals explained above can be joined to each other and/or to a line only with difficulty.

Thus, there is a need to provide an electric terminal for leading a line through a wall, in which a first terminal piece and a second terminal piece of the electric terminal can be joined to each other and/or to the line very easily and securely.

SUMMARY

Accordingly, an aspect relates to an electric terminal for leading a line through a wall, which electric terminal comprises a first terminal piece to be mounted on one side of the wall and a second terminal piece to be mounted on the other side of the wall, wherein the first terminal piece comprises a first connecting member and a retaining element for positioning the first connecting member, and the second terminal piece comprises a bus bar to be connected electrically to the first connecting member.

According to the invention, an electric terminal of such type for leading a line through a wall is provided, in which electric terminal the first connecting member can be connected very easily to the line and/or to the bus bar due to the positioning of the first connecting member in the first terminal piece enabled by the retaining element. In other words, the retaining element causes the first connecting element to be secured in the first terminal piece in such a way that, when the first terminal piece and the second terminal piece are joined together, the bus bar attached to the second terminal piece can be connected very easily to the first connecting member of the first terminal piece and/or the retaining element provides an equally easy possibility of connecting a line to the first connecting member of the first terminal piece. Preferably, the second terminal piece comprises a second connecting member so that an electrically conductive connection is established by means of the bus bar between the first connecting member and the second connecting member in the connected state of the electric terminal.

According to a further embodiment of the invention, the first terminal piece comprises a first securing means for securing the bus bar and/or the line on the first connecting member. Provision can likewise be made for the second terminal piece to comprise a second securing means for securing the bus bar and/or the line on the second connecting member. The bus bar and the line can be attached to the first connecting member easily and securely by means of a securing means of such type.

In principle, the retaining element can have any desired shape. According to a preferred development of the invention, the retaining element secures the first connecting member in the disconnected state of the electric terminal. Thus it is possible to ensure, for example, even before the assembly of the electric terminal, that the line can be attached very easily to the first connecting member since the retaining element secures the first connecting member in the first terminal piece in such a way that the line can be connected to the first connecting member with particular ease.

The retaining element can be snapped onto the first connecting member. Such type of an embodiment enables, for example, the retaining element to be mounted very easily since the connecting member can be readily provided with the retaining element.

According to a further embodiment of the invention, the first terminal piece comprises at least one rib for securing the retaining element. It is further preferred that the first terminal piece comprise two ribs, and the two ribs form a groove for securing the retaining element. In other words, ribs of such type firstly allow the retaining element to be secured when the same is mounted on the first connecting member, and secondly they allow the retaining element to be secured when the electric terminal is being used so that a repeated attachment and/or detachment of the bus bar and/or the line to and from the first connecting member is facilitated respectively.

In principle, the retaining element the retaining element can have any desired shape. Provision is made according to a further preferred embodiment of the invention, for the retaining element to be in the form of a retaining plate. Furthermore, the retaining element can preferably be locked into position by means of the at least one rib in the first terminal piece. In this context, it is further preferred to be able to secure the retaining plate in the groove.

According to a further embodiment of the invention, the first terminal piece preferably comprises a first covering flap, which can pivot and which, in its closed state, covers the first connecting member, the retaining element, the first securing means and/or the bus bar, at least in part. Likewise, the second terminal piece preferably comprises a second covering flap that has a similar design as the first covering flap. A covering flap of such type enables the connecting member, the retaining element, the securing means and/or the bus bar to be covered, at least in part, in such a way that the covering flap provides protection from pollution and/or protection of the electric voltage and/or current present at the connecting member, the retaining element, the securing means and/or the bus bar.

In this context, the first covering flap, in its closed state, hold the first securing means such that the latter is not detachable. Furthermore, the second covering flap, in its closed state, preferably holds the second securing means such that the latter is not detachable. Such an embodiment firstly prevents an undesirable detachment of the bus bar from the connecting member that can be secured by the securing means, and secondly it likewise prevents a detachment of the line that can be connected by the securing means from the connecting member.

In principle, the bus bar can have any desired shape. According to a further embodiment of the invention, a first end of the bus bar preferably has a fork-like formation, and the fork-like formation of the bus bar can be secured between the first connecting member and the first securing means. An embodiment of such type, more particularly the length of the fork-like formation, enables the bus bar to be provided with varying thickness and/or length. In this context, it is further preferred that the bus bar be insertable into the first terminal piece.

According to another development of the invention, the first terminal piece preferably further comprises a connecting element for connection to the second terminal piece, which connecting element can be inserted into the second terminal piece, and the bus bar can be inserted into the connecting element. In principle, the connecting element can have any desired profile. However, the connecting element preferably has a rectangular or a tubular profile. Furthermore, the bus bar preferably has a rectangular profile so that the connecting element can bear positively against the bus bar.

In principle, the first connecting member can have any desired shape. According to another development of the invention, the first connecting member is preferably in the form of a connecting bolt or a screw-connection member, the first securing means is in the form of a screw nut, and the screw nut can be screwed onto the connecting bolt or the screw-connection member. Furthermore, the line that can be connected to the electric terminal preferably comprises a screw connection comprising a clamping sleeve for connection to the connecting member. Preferably, the connecting member, the securing means and/or the bus bar are dimensioned based on the current and/or voltages that can be expected on the line.

In principle, the connecting element can have any desired shape. According to a preferred development of the invention, the connecting element further comprises an at least partially alternating groove-like and spring-like structuring and/or a tooth-like structuring on that surface of the connecting element that is distal from the bus bar. Furthermore, the surface of the connecting element that is distal from the bus bar preferably comprises an at least partially angular structuring and/or a rib-like structuring. An embodiment of such type increases the leakage distance, specifically as compared to a flat-shaped surface so that higher voltage can be applied to the electric terminal of the invention than to one in which the connecting element has a flat surface, in particular.

BRIEF DESCRIPTION

The invention is explained below in more detail with reference to the drawings.

DETAILED DESCRIPTION

Figure 1:
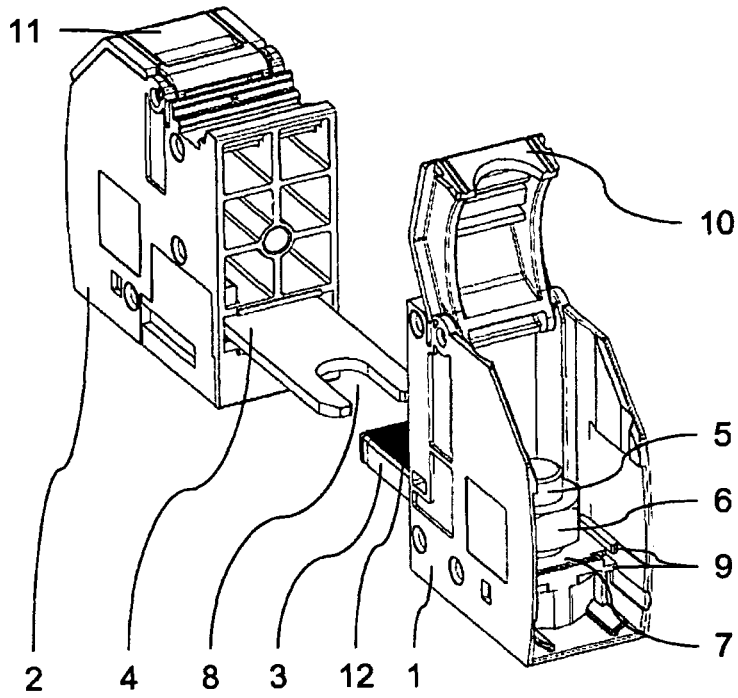
FIG. 1 is a perspective view of an electric terminal in a disconnected state according to a preferred exemplary embodiment of the invention.
Figure 2:
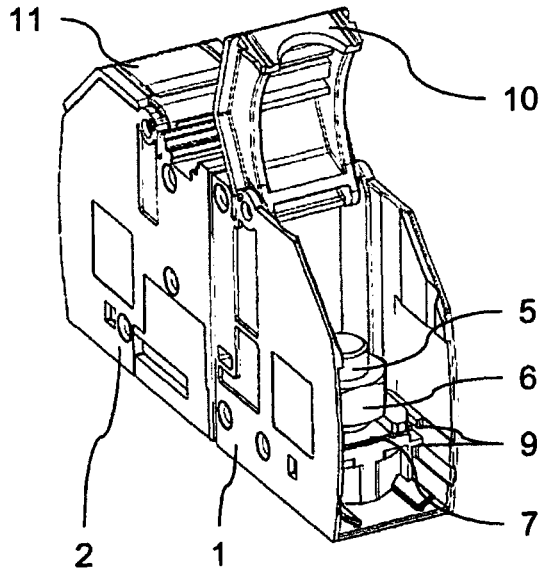
FIG. 2 is a further perspective view of an electric terminal in a connected state according to the preferred exemplary embodiment of the invention.
Figure 3:
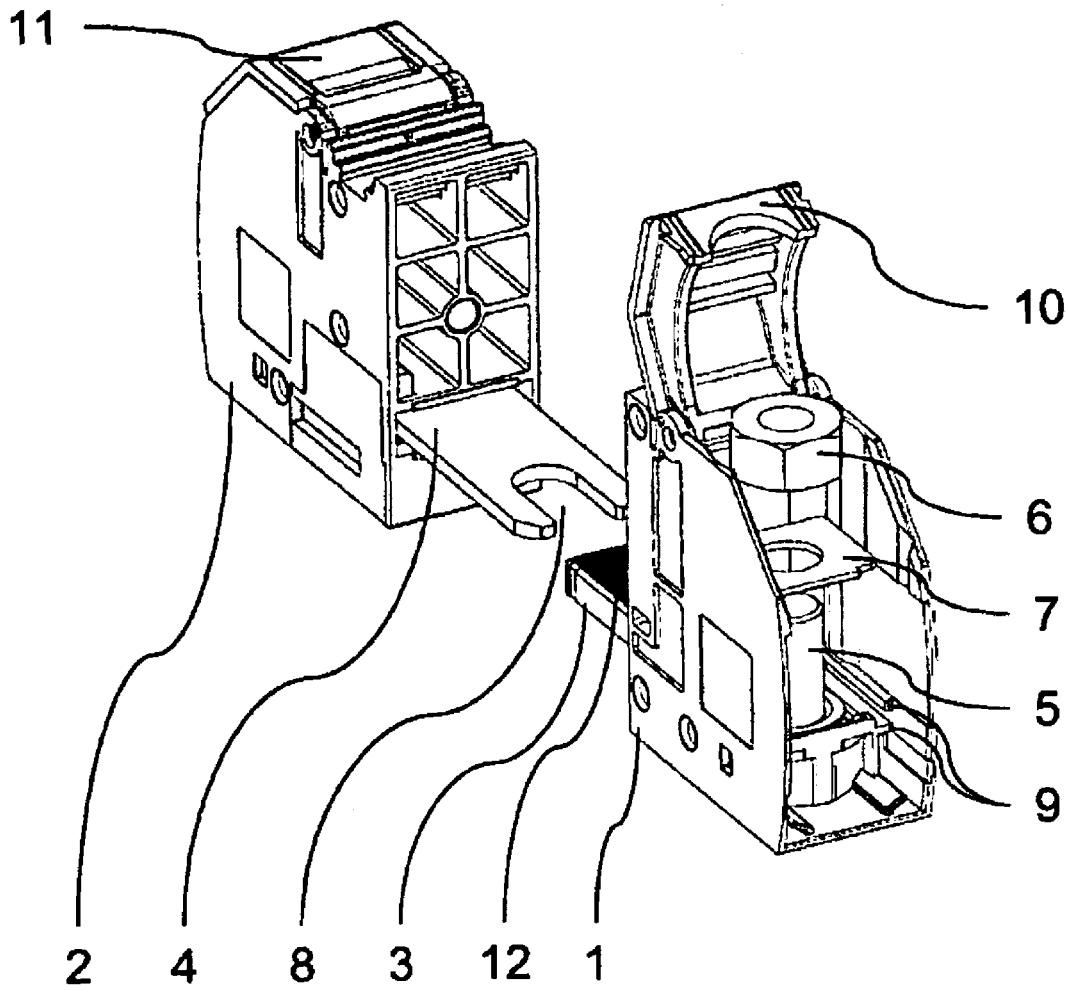
FIG. 3 is a further perspective view of the electric terminal in a disconnected state according to the preferred exemplary embodiment of the invention.

FIGS. 1 to 3 show an electric terminal for leading a line through a wall (not illustrated), which electric terminal comprises a first terminal piece 1 to be mounted on one side of the wall, and a second terminal piece 2 to be mounted on another side of the wall.

In principle, the second terminal piece 2 can be attached to an internal surface of the wall in the form of an internal terminal piece, and the first terminal piece 1 can be attached to an external surface of the wall in the form of an external terminal piece. However, it is preferable to arrange the first terminal piece 1 in the form of an internal terminal piece on an internal surface of the wall, and the second terminal piece 2 in the form of an external terminal piece on an external surface of the wall. The wall can be, for example, a metallic wall of an electric installation socket or a control cabinet.

According to the preferred exemplary embodiment of the invention, the first terminal piece 1 comprises a connecting element 3 for connection to the second terminal piece 2. When the first terminal piece 1 and the second terminal piece 2 are joined together, as shown in FIG. 2, the connecting element 3 is inserted into the second terminal piece 2. A bus bar 4 disposed on the second terminal piece 2, as shown in FIG. 1 or FIG. 3, is inserted positively into the connecting element 3 of the first terminal piece 1. The bus bar 4 that can be in the form of a metallic current bar enables an electric connection to be established between a first connecting member 5 assigned to the first terminal piece 1 and a second connecting member (not illustrated) assigned to the second terminal piece 2.

As shown in the figures, the first connecting member 5 is in the form of a screw-connection member and it comprises a securing means 6 that is screwed onto the connecting member 5, as shown in FIGS. 1 and 2. The bus bar 4 and/or a line (not illustrated) can be attached to the connecting member 5 by the securing means 6.

The first terminal piece 1 further comprises a retaining element 7 that is in the form of a retaining plate here and can be snapped onto the first connecting member 5, as shown in FIG. 3. Provision can further be made for a washer, for example, an anti-vibration washer, between the securing means 6 that is in the form of a metric screw nut here and the first connecting member 5.

The retaining element 7 serves for positioning the first connecting member 5 in the first terminal piece 1. For example, the retaining element 7 secures the first connecting member 7 [sic: 5] in the first terminal piece 1 in the disconnected state of the electric terminal. Firstly, this facilitates the insertion of the bus bar 4 into the first terminal piece 1, for which purpose a first end of the bus bar 4 has a fork-like formation 8, and this fork-like formation 8 of the bus bar 4 can be secured between the first connecting member 5 and the first securing means 6. Secondly, the positioning of the first connecting member 5 in the first terminal piece 1 enabled by the retaining element 7 allows the line to be inserted easily into the first terminal piece 1 and joined to the first connecting member 5.

The first terminal piece 1 comprises two ribs 9 that form a groove for securing the retaining element 7 in the first terminal piece 1. Thus, for the purpose of assembly as shown in FIG. 3, the retaining element 7 can be pushed from the top by way of the first connecting member 5 and pressed over the ribs disposed laterally on the first terminal piece 1 in such a way that the retaining element 7 snaps into place in the groove formed by the ribs 9.

As shown further in FIG. 1 to FIG. 3, the first terminal piece 1 comprises a first covering flap 10, and the second terminal piece 2 comprises a second covering flap 11. The first covering flap 10 and/or the second covering flap 11 are provided so as to be able to pivot on the first terminal piece 1 and the second terminal piece 2 respectively, and the respective covering flap 10, 11 covers the connecting member 5, the retaining element 7, the securing means 6 and/or the bus bar 5 [sic: 4] at least in part, in the closed state of the covering flaps. Furthermore, the respective covering flap 10, 11, in its closed state, holds the securing means 6 such that the latter is not detachable. This prevents an undesirable detachment of the securing means 6, that is, an undesirable detachment of the line from the connecting member 5 or an undesirable detachment of the bus bar 4 from the connecting member 5.

Furthermore, that surface of the connecting element 3 that is distal from the bus bar 4 comprises an at least partially alternating groove-like and spring-like structuring 12 that effects a "leakage-distance extension", that is to say, enables the application of a higher current and/or higher voltage to the electric terminal as compared to a flat surface of a connecting element 3, in particular.

In conclusion, an electric terminal is provided for leading a line through a wall, which electric terminal very easily allows a connection of the first terminal piece 1 to the second terminal piece 2 and/or a connection of the line to the first terminal piece 1 and/or the second terminal piece 2. Furthermore, the covering flap 10, 11 of the invention prevents an undesirable detachment of the securing means 6, thus the first terminal piece 1, from the second terminal piece 2, and/or an undesirable detachment of the line from the electric terminal.

LIST OF REFERENCE NUMERALS

First terminal piece 1
Second terminal piece 2
Connecting element 3
Bus bar 4
First connecting member 5
First securing means 6
Retaining element 7
Fork-like formation 8
Rib 9
First covering flap 10
Second covering flap 11
Structuring 12

The invention claimed is:

1. An electric terminal for leading a line through a wall, the electric terminal comprising:

a first terminal piece configured to be mounted on a first side of the wall; and a second terminal piece configured to be mounted on a second side of the wall;

wherein the first terminal piece includes a first connecting member and a retaining element for positioning the first connecting member, wherein the second terminal piece includes a bus bar for electrically connecting to the first connecting member;

wherein the first terminal piece includes a first securing means for securing at least one of the bus bar and a line on the first connecting member;

wherein the first terminal piece includes a first covering flap that pivots and in a closed state, and covers one or more of the first connecting member, the retaining element, the first securing means and the bus bar, at least in part.

2. The electric terminal as defined in claim 1, wherein the retaining element secures the first connecting member in a disconnected state of the electric terminal.

3. The electric terminal as defined in claim 1, wherein the retaining element is snapped onto the first connecting member.

4. The electric terminal as defined in claim 1, wherein the first terminal piece includes at least one rib for securing the retaining element.

5. The electric terminal as defined in claim 1, wherein the first terminal piece includes at least two ribs, and the at least two ribs form a groove for securing the retaining element.

6. The electric terminal as defined in claim 1, wherein the retaining element is in the form of a retaining plate.

7. The electric terminal as defined in claim 4, wherein the retaining element is locked into position by means of the at least one rib in the first terminal piece.

8. The electric terminal as defined in claim 1, wherein the first covering flap, in the closed state, holds the first securing means such that first securing means is not detachable.

9. The electric terminal as defined in claim 1, wherein a first end of the bus bar has a fork-like formation, and the fork-like formation of the bus bar is secured by the first securing means against the first connecting member.

10. The electric terminal as defined in claim 1, wherein the bus bar is inserted into the first terminal piece.

11. The electric terminal as defined in claim 1, wherein the first terminal piece includes a connecting element for connection to the second terminal piece, wherein the connecting element is inserted into the second terminal piece, and the bus bar is inserted into the connecting element.

12. The electric terminal as defined in claim 1, wherein the first connecting member is in the form of at least one of a connecting bolt and a screw-connection member, the first securing means is in the form of a screw nut, wherein the screw nut is screwed onto at least one of the connecting bolt or the screw-connection member.

13. The electric terminal as defined in claim 11, wherein the connecting element includes at least one of an at least partially alternating groove-like and spring-like structuring and a tooth-like structuring on a surface of the connecting element that is distal from the bus bar.

14. An electric terminal for leading a line through a wall, the electric terminal comprising:

a first terminal piece configured to be mounted on a first side of the wall; and a second terminal piece configured to be mounted on a second side of the wall;

wherein the first terminal piece includes a first connecting member and a retaining element for positioning the first connecting member, wherein the second terminal piece includes a bus bar for electrically connecting to the first connecting member;

wherein the first terminal piece includes a first securing means for securing at least one of the bus bar and a line on the first connecting member;

wherein a first end of the bus bar has a fork-like formation, and the fork-like formation of the bus bar is secured by the first securing means against the first connecting member;

wherein the first connecting member is in the form of at least one of a connecting bolt and a screw-connection member, the first securing means is in the form of a screw nut, wherein the screw nut is screwed onto at least one of the connecting bolt or the screw-connection member.

* * * * *